US007284679B2

(12) United States Patent
Zill et al.

(10) Patent No.: US 7,284,679 B2
(45) Date of Patent: Oct. 23, 2007

(54) METHOD OF DISPENSING PULVERULENT CONTENTS AND APPARATUS FOR IMPLEMENTING THIS METHOD

(75) Inventors: Tobias Zill, Hattenhofen (DE); Manfred Reiser, Winnenden (DE)

(73) Assignee: Harro Hofliger Verpackungsmaschinen GmbH, Allmersbach Im Tal (DE)

( * ) Notice: Subject to any disclaimer, the term of this patent is extended or adjusted under 35 U.S.C. 154(b) by 404 days.

(21) Appl. No.: 10/866,068

(22) Filed: Jun. 10, 2004

(65) Prior Publication Data

US 2005/0023288 A1 Feb. 3, 2005

(30) Foreign Application Priority Data

Jun. 12, 2003 (DE) ..... 203 09 279 U
Jul. 7, 2003 (DE) ..... 103 30 771

(51) Int. Cl.
*G01F 11/00* (2006.01)

(52) U.S. Cl. ..... 222/1; 222/636; 222/195; 222/368; 222/363

(58) Field of Classification Search ..... 222/636, 222/363, 368, 306, 195; 210/483, 484, 490, 210/496

See application file for complete search history.

(56) References Cited

U.S. PATENT DOCUMENTS 2,268,725 A * 1/1942 Steel ..... 222/328
2,540,059 A * 1/1951 Stirn et al. ..... 141/1
2,794,772 A * 6/1957 Savoca et al. ..... 208/304
3,656,518 A * 4/1972 Aronson ..... 141/1
4,640,448 A * 2/1987 Trechsel ..... 222/636
4,709,837 A * 12/1987 Erdman ..... 222/636
5,826,633 A * 10/1998 Parks et al. ..... 141/18
5,881,357 A 3/1999 Takemoto et al.
5,906,297 A * 5/1999 Cole ..... 222/134
6,267,155 B1 * 7/2001 Parks et al. ..... 141/18
6,581,650 B2 * 6/2003 Parks et al. ..... 141/12
6,837,281 B2 * 1/2005 Spiers et al. ..... 141/125

FOREIGN PATENT DOCUMENTS

DE 3625034 7/1987
WO WO-0156726 8/2001

* cited by examiner

*Primary Examiner*—Kevin Shaver
*Assistant Examiner*—Stephanie E. Tyler
(74) *Attorney, Agent, or Firm*—Darby & Darby

(57) ABSTRACT

An apparatus for dispensing respectively predetermined quantities of pulverulent contents has a rotatably drivable metering roller containing at least one metering chamber and a material store which stores the pulverulent contents. The metering roller contains at least one lateral line, which is not line-connected to the metering chamber and of which the at least two line ends terminate on the surface of the metering roller. A gas line is guided into the housing and passes out of the housing again in a concave surface region. Gas is introduced into the material store via the lateral line, in dependence on the respective rotary position of the metering roller, through said gas line. Depending upon the rotary positions of the metering roller, the gas line, which fluidizes the contents present in the material store, is closed or opened by the metering roller.

21 Claims, 6 Drawing Sheets

FIG. 7
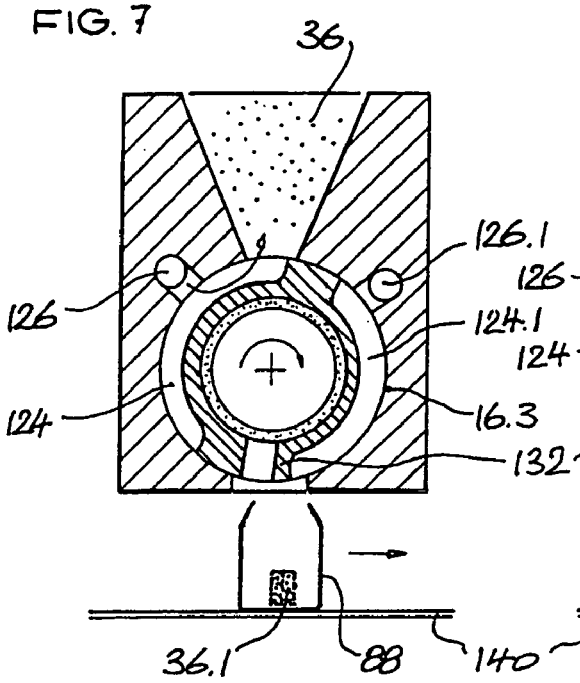
FIG.8
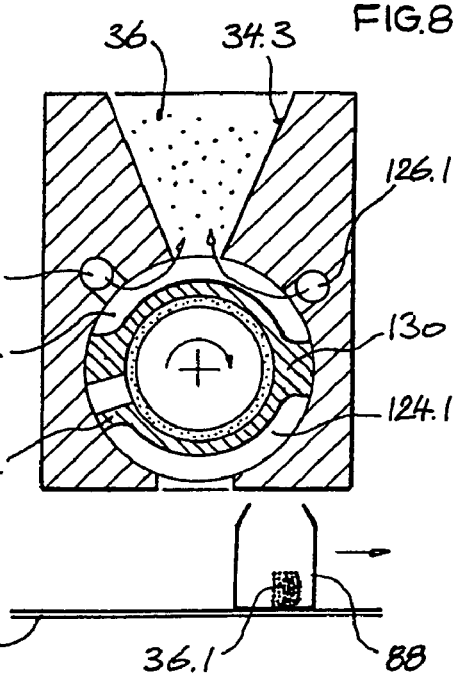
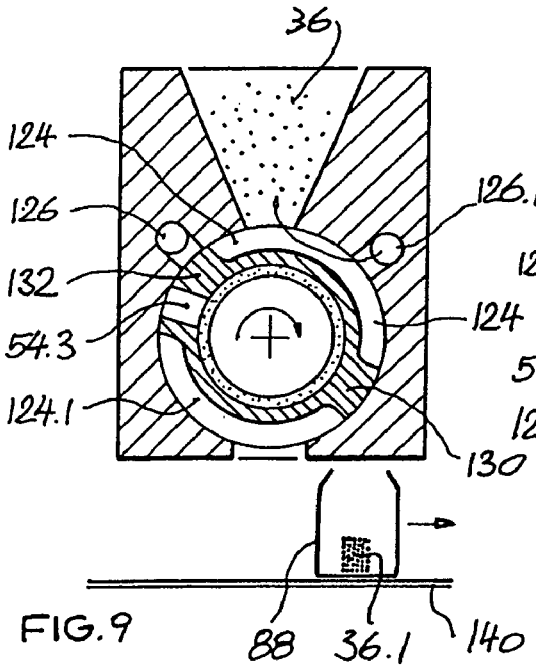
FIG.9
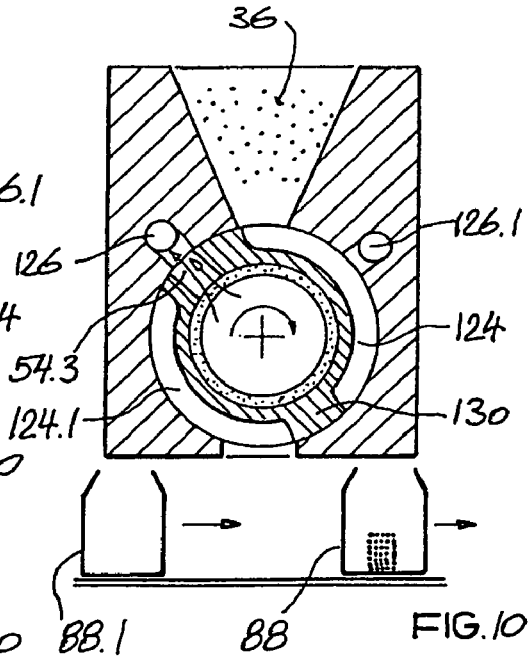
FIG.10

FIG. 11
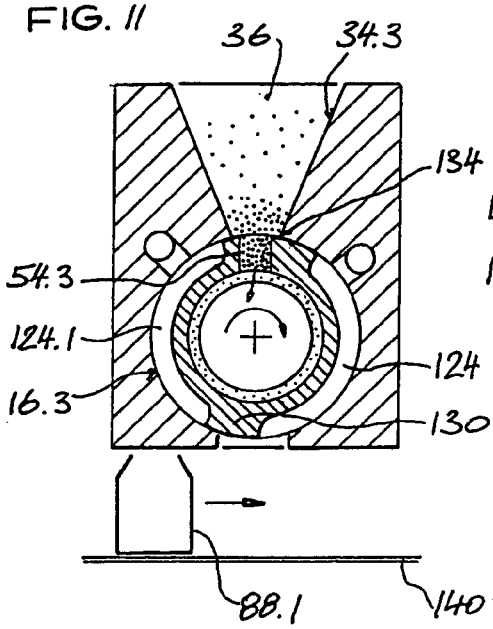
FIG. 12
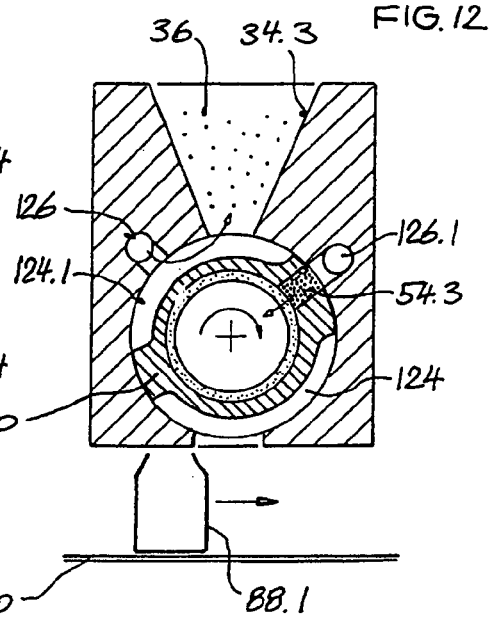
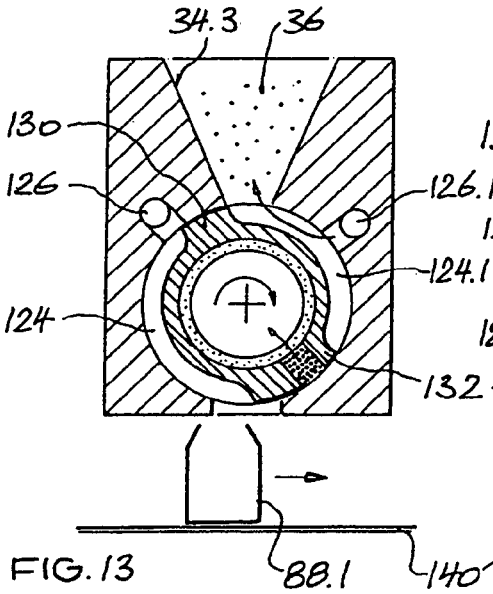
FIG. 13
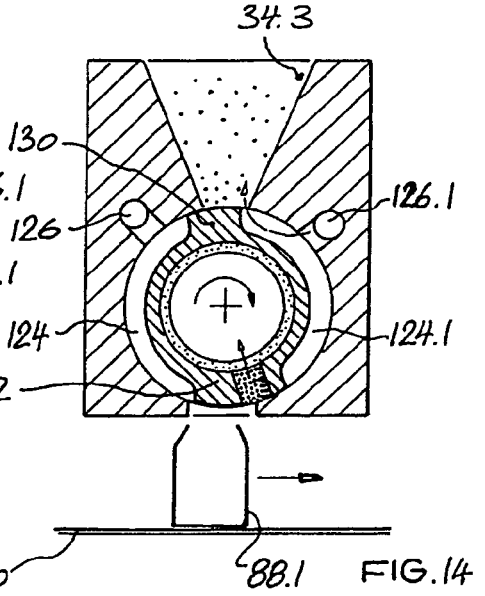
FIG. 14

METHOD OF DISPENSING PULVERULENT CONTENTS AND APPARATUS FOR IMPLEMENTING THIS METHOD

TECHNICAL FIELD

The invention relates to a method of, and an apparatus for, dispensing respectively predetermined quantities of pulverulent contents. The respective dispensing quantities are to be as constant as possible. The contents which are to be dispensed in each case are introduced into a metering chamber and transported from the latter to a container which is to be filled in each case. The contents present in the metering chamber are then emptied into such an available container.

Such dispensing devices may be designed as so-called metering tubes or as a metering roller. Whereas a metering tube, for filling purposes, is inserted from above into a stationary bed of bulk material, the metering chambers, which are distributed over the outer circumference of a metering roller, are positioned one after the other beneath the base opening of a contents-storing material store during the respective filling operation.

PRIOR ART

U.S. Pat. No. 5,826,633 discloses a metering roller with a plurality of metering chambers which are offset laterally above the base opening of a downwardly tapering, contents-accommodating material store. Terminating in the base opening of this material store is a gas line through which a gaseous medium is introduced into the material store from beneath, and the contents present in the material store can thus be fluidized. The metering chamber opening laterally into the region of the material store is bounded at the rear of its base by a filter which is permeable to gas but impermeable to contents. Depending on the rotary position of the metering roller, and thus on the position of the metering chambers of the latter, by way of a positive pressure or negative pressure being correspondingly applied through the filter, contents can be sucked into the metering chamber from the material store or the contents sucked into the metering chamber are blown out of the metering chamber into a container provided beneath the metering chamber. On account of the metering roller positioned above the base opening of the hopper-like material store, it is not possible for the contents present in the base region of the material store to be removed in their entirety from the material store; between the base opening of the material store and the metering chamber positioned thereabove, there is always an unusable residual quantity of contents remaining in the bottom hopper-like base region of the material store. Since it cannot be ensured whether, and when, this residual quantity is sucked back into the metering chambers, this residual quantity constitutes a quantity of contents which can only be used with difficulty, if at all. It is frequently also the case that it is undesirable to use this residual quantity since, in particular in the case of medicaments which are to be dispensed, timely dispensing is necessary if decomposition or some other negative change in the powdered medication as the latter resides in the material store over a relatively long period of time is to be avoided.

DE 197 13 057 discloses a powder-filling method and an apparatus for producing preferably sintered bodies. In this case, gas is introduced into a powder container through a multiplicity of holes in order that the individual powder particles in the powder container can move relative to one another. Thereafter, the powder container together with the fluidized powder present therein is positioned above a cavity which is to be filled, and the powder is displaced into the cavity, on account of its force of gravity, by suction or compressive force. The oscillating movement of the powder container is disadvantageous, this precluding a high dispensing performance. In particular, however, the arrangement of the very large number of gas-introduction tubes in the powder container proves to be disadvantageous in design terms.

The powder-filling apparatus which is known from WO 01/56726 also serves preferably for producing sintered bodies. Its material store has porous walls for the introduction of the gas which is to be used for fluidizing purposes. The porous walls prove to be particularly disadvantageous since, during the processing of contents which are to be handled very carefully, in particular pharmaceutical powders, the latter, if fine-grained enough, can settle in the porous walls. This results in it no longer being possible to guarantee hygienic dispensing.

DE 36 25 034 discloses an apparatus for automatically dispensing a free-flowing, pulverulent product into containers. This apparatus essentially comprises a vertically arranged, tubular measuring chamber which has a filter as the top boundary element. The quantity of powder which is to be dispensed is introduced in each case into the measuring chamber. The wall of the measuring chamber contains a mouth opening which is always open and is connected, by means of a connecting line, to a powder store arranged to the side of the measuring chamber. The measuring chamber comprises, in part, an elastic hose which, by virtue of being pinched, prevents powder from flowing prematurely out of the measuring tube into a container. Gas is introduced into the measuring chamber through the filter present at the top of the measuring chamber, this gas, with the hose pinched, being directed straight into the powder store and thus being capable of serving for fluidizing the contents present in the powder store. By virtue of a vacuum being applied to the filter, fluidized contents can be sucked upwards out of the powder store, through the connecting line, into the measuring chamber, as far as the region of the filter. In the case of this operation of filling the measuring chamber with powder, the measuring line is pinched beneath the connecting line. In order for the quantity of powder which is contained in the measuring chamber to be transferred to a container, the pinched hose cross section is released and a surge of compressed air into the measuring chamber is generated through the filter, this surge of compressed air forcing the quantity of powder downward out of the measuring chamber, in which case the powder present in the connecting component is sheared off laterally in relation to the quantity of powder driven out by the pressure surge. During the subsequent renewed fluidizing operation, the quantity of powder remaining in the connecting component is conveyed back into the powder store. The problem here is the unavoidable effect of the shearing operation precluding the respective quantities of powder from being separated off precisely from one another. This results in relatively large fluctuations in the quantities of powder which are to be dispensed in each case, which is undesirable, for example, in the case of dispensing medicaments. It is also possible, on account of the flexing movements of the hose wall brought about during the pinching operation and of the resulting pronounced material fatigue of the hose, for particles to be detached therefrom and then to be included in the dispensing operation; this is unacceptable in the operation of dispensing a medicament.

DESCRIPTION OF THE INVENTION

Taking this prior art as the departure point, the object of the invention is to specify a possible way of dispensing pulverulent contents which allows, as far as possible, constant quantities of pulverulent contents to be dispensed by as straightforward and compact a dispensing apparatus as possible, the intention being for this dispensing apparatus to be straightforward to handle during operation. Nevertheless, the dispensing operation using such a dispensing apparatus is to be capable of being carried out as cost-effectively as possible.

This invention is achieved, in respect of the method according to the invention, by the features of claim 1 and, in respect of an apparatus according to the invention, on which this method is to be implemented, by the features of claim 5. Expedient developments both of the method and of the apparatus form the subject matter of further claims which follow claims 1 and 5 in each case.

The invention is distinguished, in particular, in that the metering roller itself also functions as a kind of closing valve for the gas line serving for fluidizing the contents present in the material store, in that, in dependence on the respective rotary position of the metering roller, this gas line is or is not closed by the metering roller. The duration of the individual dispensing cycles thus does not depend on any actual valve arrangements for opening and closing such a gas line. Furthermore, the absence of such valve arrangements also reduces the cleaning outlay for the dispensing apparatus according to the invention.

Depending on the type of metering apparatus present, the metering roller can be rotated in the same direction of rotation, or in oscillating rotary movements, upon successive filling and emptying of its at least one metering chamber. More specific method-related details are also mentioned in conjunction with the embodiments for dispensing apparatuses according to the invention which are described more specifically hereinbelow.

A first type of dispensing apparatus according to the invention has a metering roller which contains at least one lateral line. This at least one lateral line is not line-connected to the metering chamber. Depending on the rotary position of the metering chamber, a line connection between the material store which stores the pulverulent contents and the gas line serving for fluidizing the contents stored in the material store may or may not be produced via this lateral line. It is thus possible, within a relatively long period of each dispensing cycle, for the material store to be subjected to the action of fluidizing gas. This allows very short operating cycles.

The metering roller may contain, as metering chamber, a filter piston apparatus as is described in more detail in German Utility Model Application 203 09 279.1, the priority of which is claimed. You are expressly referred to the full details of this filter piston apparatus in this respect.

Further configurations and advantages of the invention can be gathered from the features further cited in the claims and from the exemplary embodiments illustrated in the drawing.

BRIEF DESCRIPTION OF THE DRAWING

The invention is explained and described in more detail hereinbelow with reference to the exemplary embodiments illustrated in the drawing, in which:

FIGS. 6 to 14 show illustrations, in detail form, of a third dispensing apparatus according to the invention in different rotary positions.

WAYS OF IMPLEMENTING THE INVENTION

Figure 4:
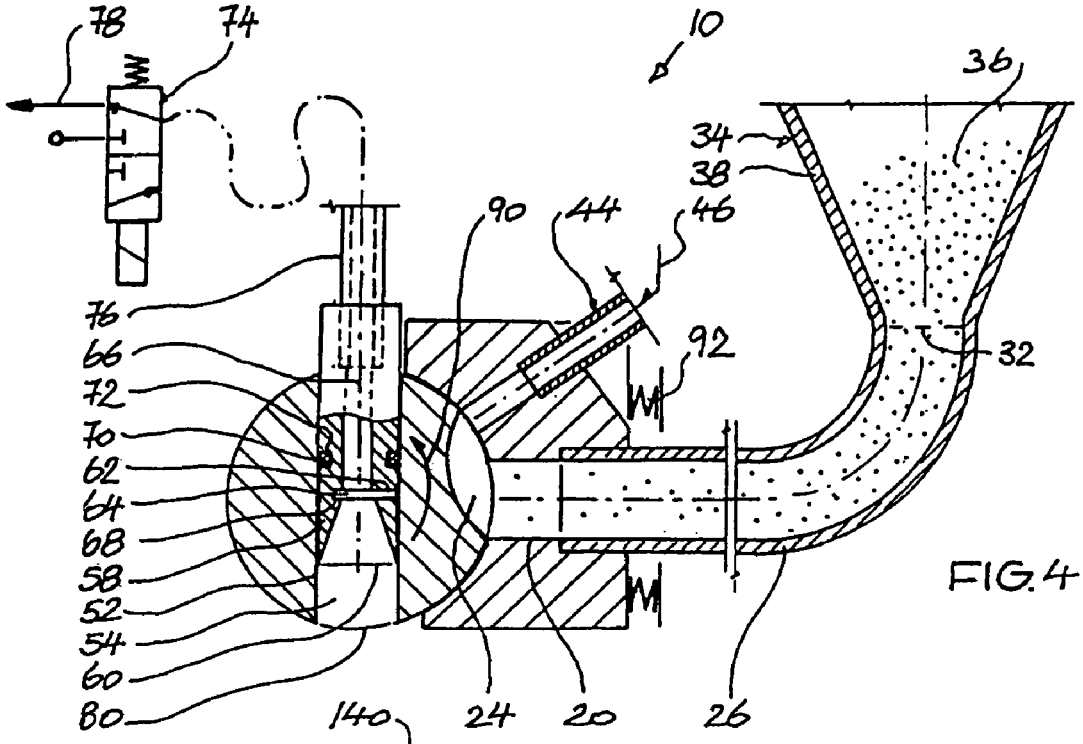
FIG. 4 shows an illustration similar to that of FIG. 3, with the metering chamber emptied.

A first embodiment of a dispensing apparatus 10 according to the invention, which is illustrated in FIGS. 1 to 4, has a block-like housing 12. The housing 12 has a concave surface region 14. An essentially circular-cylindrical metering roller 16 fits closely, by way of its convex surface region 18, against the concave surface region 14 of the housing 12.

A first and a second through-passage channel 20, 22 project through the housing 12 and terminate in the concave surface region 14 of the housing 12.

Figure 3:
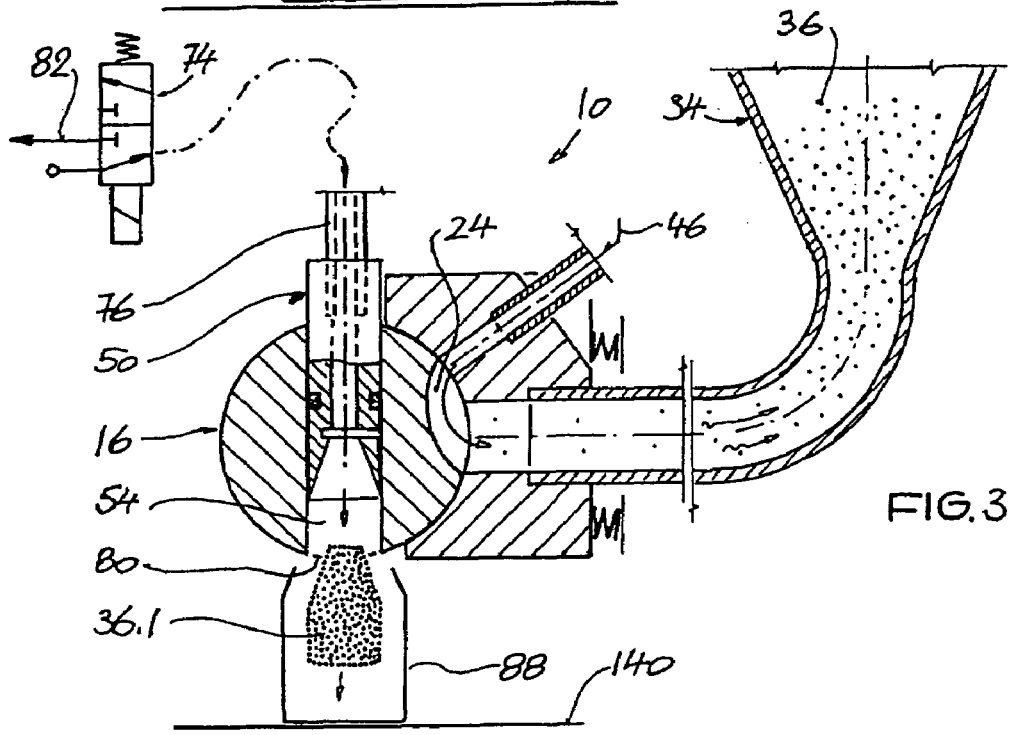
FIG. 3 shows an illustration of this dispensing apparatus in its emptying position.

A surface region of the metering roller 16 contains a recessed formation which constitutes a lateral line 24. In the so-called second rotary position of the metering roller 16, which is illustrated in FIGS. 3 and 4, this lateral line 24 constitutes a connection between the first and the second through-passage channels 20, 22. In the so-called first rotary position of the metering roller 16, which is illustrated in FIG. 1, the second through-passage channel 22 is not connected to the first through-passage channel 20; the convex surface region 18 of the metering roller 16 closes the second through-passage channel 22, which terminates in the concave surface region 14 of the housing 12.

Figure 1:
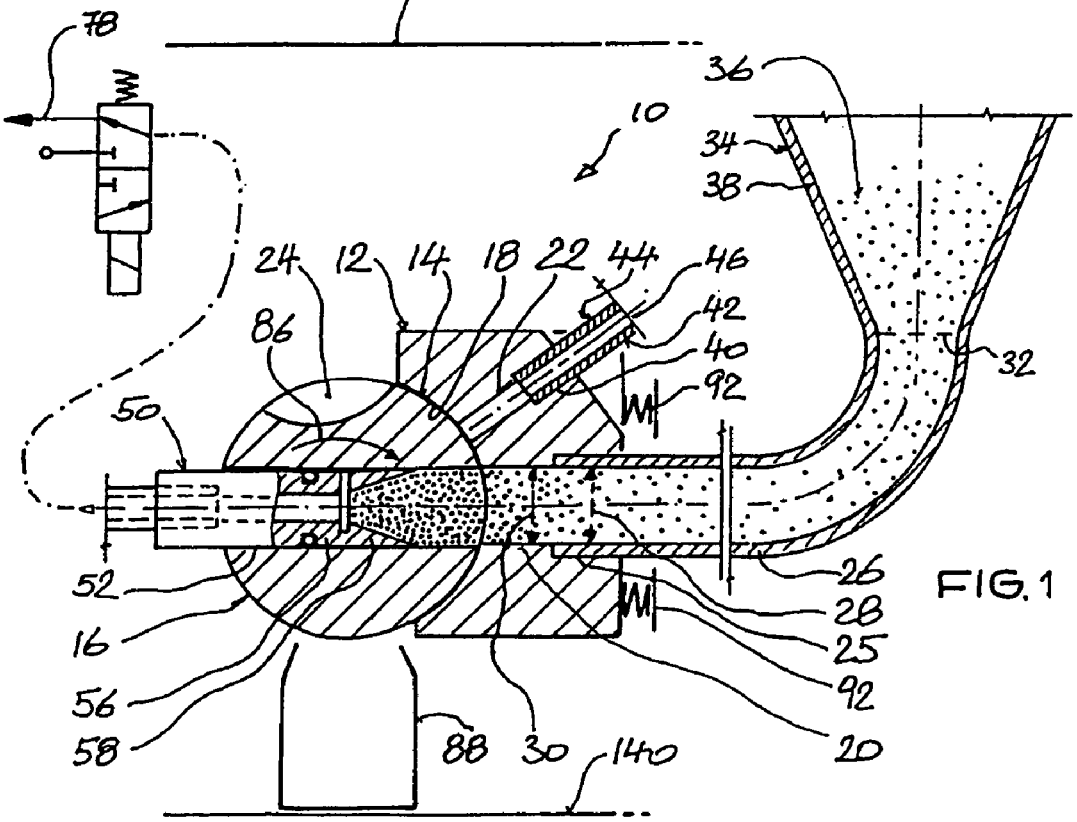
FIG. 1 shows an illustration, in detail form, of a first dispensing apparatus according to the invention in a first rotary position of its metering roller, with a filter piston apparatus arranged therein.

The first through-passage channel 20 widens into an accommodating bore 25 at its right-hand end in FIG. 1. The diameter of the accommodating bore 25 relative to the diameter 30 of the first through-passage channel 20 is such that the internal diameter 28 of a hose 26 corresponds to the diameter 30 of the first through-passage channel 20, with the result that the lowest possible flow resistance arises in the transition region between the hose 26 and first through-passage channel 20. Instead of the flexible hose 26, it would also be possible to use a stiff tube.

The hose 26 terminates at the outlet opening 32 of a material store 34, which stores pulverulent contents 36. The hose 26 is attached to the material store 34, in the region of the outlet opening 32, in a manner which is favorable for the flow of the contents 36.

The material store 34 has a downwardly tapering hopper 38. The hopper wall is inclined such that the flow of the contents 36 out of the material store 34 produces a so-called mass flow; this means that, in all the regions of the material store 34, the contents 36 move to the same extent in the direction of the outlet opening 32, in order to avoid the contents 36 separating.

In the present example, the material store 34 is closed, for reasons of contamination, by a removable cover, which is not illustrated in the drawing. This cover allows the fluidizing gas to escape outward during the operation of fluidizing the contents 36, which is described in more detail hereinbelow. This fluidizing gas can be collected outside the material store 34.

The hose 26 which is present between the material store 34 and the first through-passage channel 20 does not have any bends or kinks which obstruct the flow of the contents 36 to any significant extent. In the present case, the hose 26 is a silicone hose.

The second through-passage channel 22 widens into an accommodating bore 40 at its right-hand end in FIG. 1. In this accommodating bore 40, a gas hose 42 is positioned in a gas-tight manner against this second through-passage channel 22. The gas hose 42 and the second through-passage channel 22 constitute a gas line 44.

In the second rotary position, which is illustrated in FIG. 4, the gas line 44 is connected to the first through-passage channel 20, and thus to the material store 34, via the lateral line 24. Gaseous medium 46 introduced into the gas line 44 from the outside can thus flow into the interior of the hopper 38 through the hose 26 and the outlet opening 32, via the lateral line 24. In the case of this gas flow, the contents located in the first through-passage channel 20 and in the hose 26 are conveyed back into the hopper 38 and are fluidized in the hopper 38 together with the pulverulent contents 36. In the case of this fluidizing operation, the static pressure applied by the contents 36 in the hopper 38 is overcome virtually in full. The porosity of the loose fill of contents in the hopper 38 is then of such a magnitude that the individual particles of the contents 36 are fully movable in relation to one another. In particular powders with small adherent particles have a pronounced fluidizing behavior since the free flow cross section of the contents vastly decreases. The fluidizing effect thus increases as such material particles pass out. Homogenous fluidization of all the pulverulent contents 36 takes place overall, which has a particularly positive effect on the metering accuracy.

Such easily fluidizable powders with adherent fines are, for example, so-called powder inhalants in which micronized active substances are bound by interparticular forces. Such interactive mixtures are inhaled for therapeutic purposes by patients as pharmaceutical preparations in the form of an air/powder mixture (aerosol) using an inhaler. During this operation, the micronized active substance, which is usually of a magnitude between 5 μm (micrometers) and 0.5 μm, separates from the carrier substance, with the result that, in a therapeutically desirable manner, only the micronized active substance passes into the human lungs for therapeutic purposes.

In addition to pharmaceutical preparations, it is also possible for other powders, for example coffee powders, to be dispensed particularly carefully by the apparatus according to the invention if an inert gas is used as the gaseous medium 46, and thus as the fluidizing medium. In the case of using an inert gas, it is not possible for any oxygen to reach the coffee powder during the dispensing operation, with the result that the coffee flavor cannot be impaired by the fluidizing medium.

The fluidizing operation in the material store 34 also has the effect of considerably reducing the dynamic viscosity of the gas/solids mixture generated by the fluidizing operation. The fluidized contents 36 thus have considerably improved flow properties, as a result of which it is possible for the first time for them to be conveyed through narrow cross sections into the metering chamber of the metering roller 16.

The metering roller 16 contains a filter piston apparatus 50, which is seated within a circular-cylindrical bore 52 of the metering roller 16. The individual parts and functioning of such a filter piston apparatus 50 are described in more detail in German patent application 203 09 279.1, the priority of which is claimed. You are expressly referred to the entire contents of this disclosure.

A hollow-cylindrical piston 56 is seated in the circular-cylindrical bore 52, which is present for the purpose of forming a metering chamber 54. In the present example, this piston is produced from a piece of tube with, in the present example, a circular cross section. The tube wall of this piston 56 is beveled conically at its right-hand end in FIG. 1, with the result that the interior of the single-piece tube, and thus also that of the piston 56, widens in the direction of the bottom end in FIG. 4 as a result of a conical widening 58 which is present there. The mouth-opening periphery 60 of the piston 56 is sharp-edged.

In the transition between the conical widening 58 and the constantly thick casing region of the piston 56, a filter 64 is inserted in a transverse slot 62 provided there, which is open on one side. The transverse slot 62, which in the present case is oriented perpendicularly to the longitudinal axis 66 of the piston 56, cuts open half of the cross section of the piston 56. The constantly thick casing of the piston 56 is thus cut open over half its circumference by the transverse slot 62. In that cross-sectional region of the piston casing which is not cut open, the transverse slot 62 extends into an inner groove 68 formed in the piston casing. The piston casing is thinner in the region of this inner groove 68 than in the respectively adjoining casing region.

The piston 56 is sealed in relation to the circular-cylindrical bore 52 by means of an O-ring 70, which is seated in an encircling groove 72.

Figure 2:
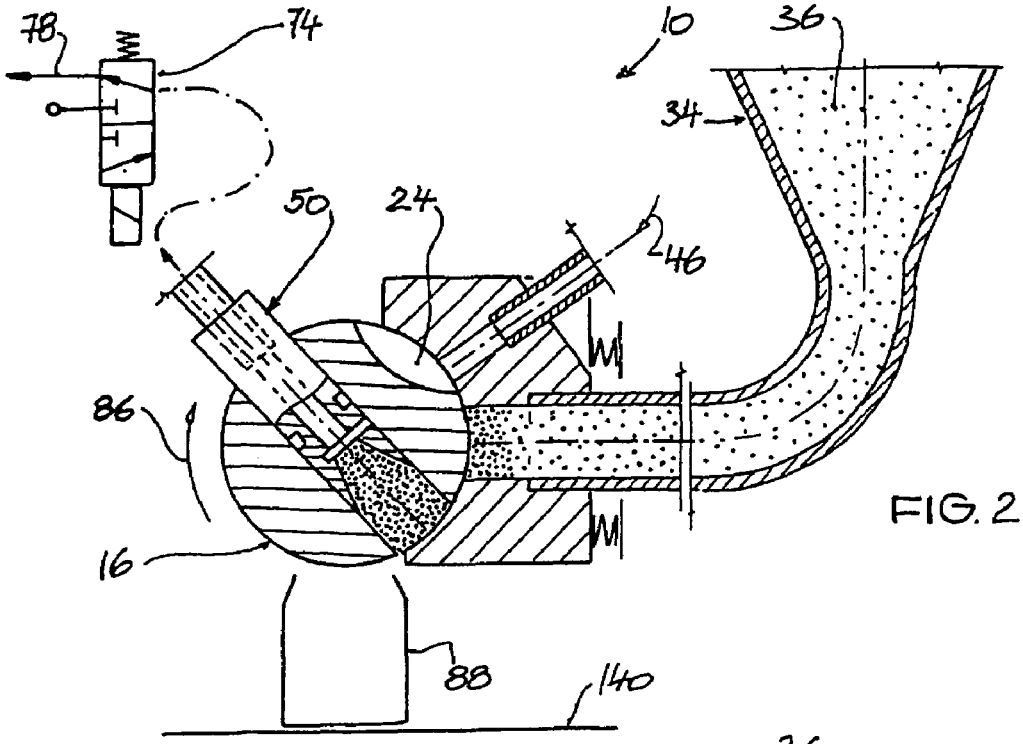
FIG. 2 shows an illustration similar to that of FIG. 1, with the metering roller in an intermediate position and the metering chamber of its filter piston apparatus filled with contents.

The rear end of the piston 56—which is at the top in FIG. 4—and thus of the filter piston apparatus 50 is attached to a two-way valve 74 by means of a gas hose 76. A line extends from the two-way valve 74 to a negative-pressure or positive-pressure gas source (not illustrated specifically). In those positions of this valve 74 which are illustrated in FIGS. 1, 2 and 4, the gas hose 76 is attached to a negative-pressure gas source (arrow 78). In this position, a negative pressure can be generated in the metering chamber 54, which is formed between the filter 64 and the mouth opening 80 of the circular-cylindrical bore 52. In that position of the valve 74 which is illustrated in FIG. 3, the gas hose 76 is attached to a positive-pressure gas source (arrow 82). A positive gas pressure can thus be produced in the metering chamber 54.

In the first rotary position (FIG. 1) of the metering roller 16, a negative pressure is generated in the metering chamber 54 and pulverulent contents 36 which are already present in the fluidized form (FIG. 4) are thus sucked out of the material store 34, through the hose 26, into the metering chamber 54. In this first rotary position, it is not possible for any fluidizing gas to be introduced into the material store 34 via the gas line 44 since the metering roller 16 closes the gas line 44.

From its first rotary position, the metering roller 16 is rotated in the clockwise direction 86—in the present case through a total of 90° (degrees)—via the intermediate position, which is illustrated in FIG. 2, into its second rotary position, which is illustrated in FIG. 3. The negative pressure in the metering chamber 54 is maintained in the process.

During this rotation, the lateral line 24 contained in the metering roller 16 enters into line connection with the first and second through-passage channels 20, 22.

In the second rotary position (FIG. 3), it is then possible to generate a positive pressure in the metering chamber 54 by virtue of the two-way valve 74 being switched over. At the same time, the contents 36 which are present in the material store 34 can be fluidized via the lateral line 24.

By virtue of this positive pressure, the quantity of powder 36.1 which is present in the metering chamber 54 is emptied out of the metering chamber from above into a container 88 provided beneath the mouth opening 80.

Axial displacement of the piston 56 in a circular-cylindrical bore 52 allows the metering chamber 54 to be rendered larger or smaller. By virtue of the piston 56 being pulled right out of the circular-cylindrical bore 52, the filter 64 can be pulled transversely out of the piston 56 and, for example, exchanged. It is then also possible, at the same time, for the piston 56 to be straightforwardly cleaned.

Following ejection of the quantity of powder 36.1 in the second rotary position of the metering roller 16, which is illustrated in FIG. 3, the situation which is illustrated in FIG. 4, and in which the metering chamber 54 is empty again and the contents 36 are fluidized once again via the lateral line 24, is re-established. By virtue of the metering roller then being rotated in the counterclockwise direction 90, the metering roller 16 once again passes into its first rotary position, which is illustrated in FIG. 1. The metering chamber 54 can then be filled with fluidized contents again in a second filling operation, as has already been described in conjunction with FIG. 1. In the present case, the metering roller 16 oscillates between two first and second rotary positions, which are illustrated in FIGS. 1 and 4.

In order for the gap between the metering roller 16 and the housing 12 to be configured to be as small as possible, and in order thus to avoid inappropriate and excess air flows, the housing 12 butts against the metering roller 16 under pressure via compression springs 92.

Figure 5:
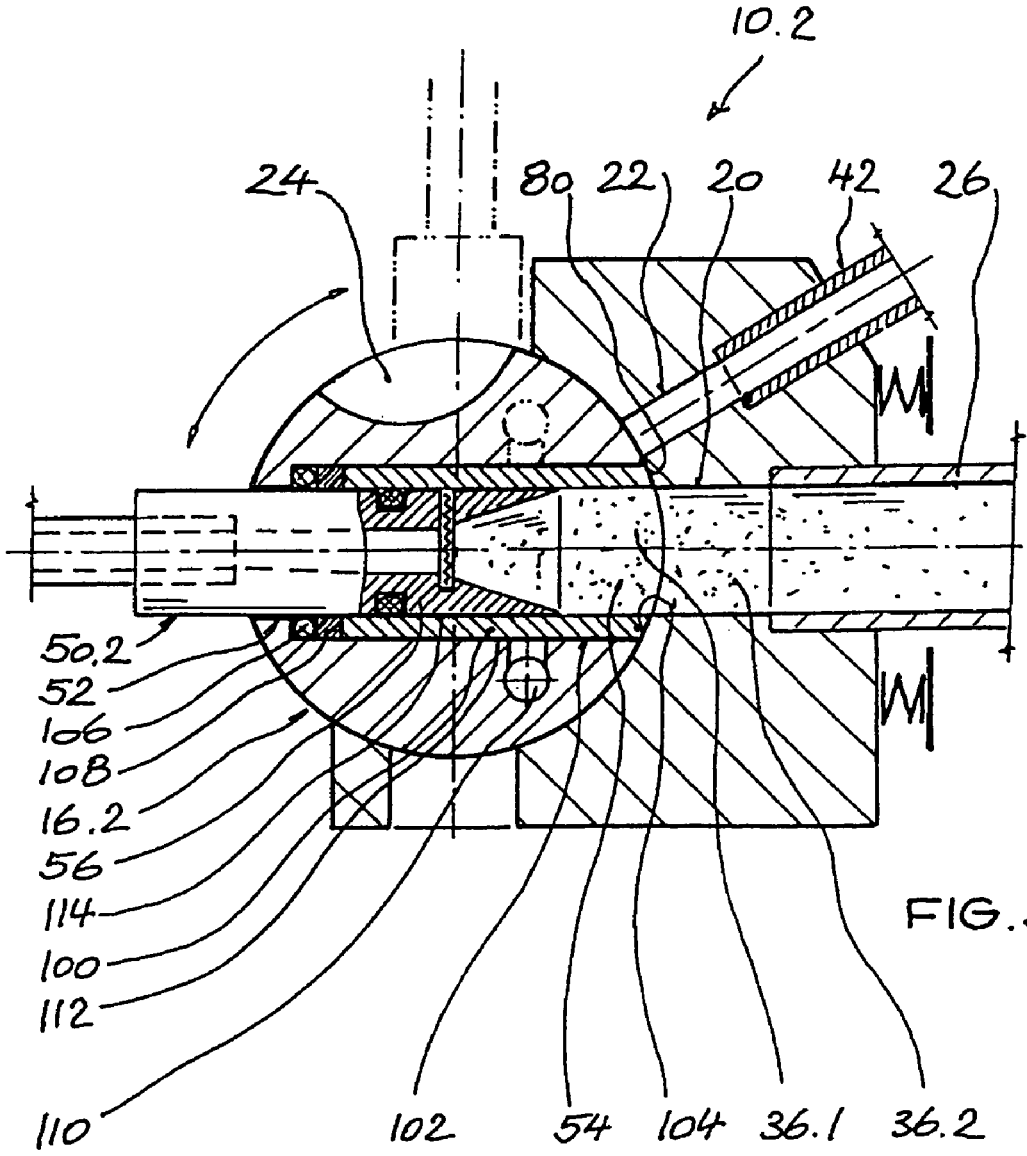
FIG. 5 shows an illustration, in detail form, of a second dispensing apparatus according to the invention, with the metering roller containing a filter piston apparatus which is somewhat modified in relation to the first dispensing apparatus.

The dispensing apparatus 10.2 illustrated in FIG. 5 differs from the abovedescribed dispensing apparatus 10 by way of its metering roller 16.2 and of the filter piston apparatus 50.2 seated therein.

In the region of its metering chamber 54 and of its surrounding O-ring 70, the piston 56 is seated in a sleeve 100 rather than directly in a circular-cylindrical bore of the metering roller. This sleeve 100, for its part, is seated in an accommodating bore 102 of the metering roller 16.2. This accommodating bore 102 however, does not go right through the metering roller 16.2. At its end which is opposite to the metering chamber 54, the accommodating bore 102 adjoins the circular-cylindrical bore 52 of the metering roller 16.2. This circular-cylindrical bore 52 corresponds to that of the metering roller 16.

The sleeve 100 has an end surface 104 which is shaped convexly to correspond to the mouth opening 80. This end surface 104 serves as a doctor blade by means of which, when the metering roller 16.2 is rotated out of its first rotary position, which is comparable to FIG. 1, into its second rotary position, which is comparable to FIG. 4, the quantity of powder 36.1 sucked into it is separated precisely from the quantity of powder 36.2 which is present in the first through-passage channel 20.

Positioned between the left-hand end of the sleeve 100 in FIG. 5 and a resiliently elastic ring, which is arranged on the end side of the accommodating bore 102 and in the present case is designed as an O-ring 106, is an annular sliding plate 108, which in the present case consists of Teflon. Without this sliding plate 108, the friction between the O-ring 106 and the sleeve 100 would be too high to ensure the elastic shape adaptability of the end edge of the end surface 104 of this sleeve 100 which takes place during the doctoring operation.

When the O-ring 106, the sliding plate 108 and the sleeve 100 are installed in the metering roller 16.2, the sleeve 100 projects slightly beyond the right-hand end of the metering roller in FIG. 5. When the metering roller 16.2 and the housing 12 are joined together, the sleeve 100 is forced axially against the O-ring 106, with the result that the sleeve 100 is forced constantly against the housing 12 by a certain normal force on account of the resilient action of the O-ring 106. This ensures constant optimum sealing between the sleeve 100 and the housing 12, even during the rotary movement of the metering roller 16.2. Since the sleeve 100 is in constant contact with the housing 12, it has a precise doctoring function during the rotary movement of the metering roller 16.2.

Terminating in the metering roller 16.2 is an air channel 110 by way of which the sleeve 100 is mounted, as it were, in a manner assisted by air pressure. The air-pressure assistance means that pulverulent contents 36 which have penetrated into the annular gap 112, which encloses the sleeve 100 on the outside, and into the further annular gap 114, which is formed between the sleeve 100 and the piston 56, are blown out of the metering chamber 54 and thus out of the filter piston apparatus 50.2. Such powder cannot be blown out of the filter piston apparatus 50.2 in the opposite direction—to the left in relation to FIG. 5—as a result of the two O-rings 70, 106 which are present there.

The dispensing apparatus 10.3 illustrated in FIG. 6*ff* has a metering roller 16.3 with, in the present case, a metering chamber 54.3. The metering roller 16.3 is mounted such that it can be rotated, for example, in the clockwise direction 86, about an axis of rotation 120. The metering chamber 54.3 constitutes a bore in the surface of the metering roller 16.3. The base of this metering chamber 54.3 is closed by a gas-permeable filter tube 122 which does not allow the pulverulent contents to pass through, and butts against a solid tube 123 from the inside. A positive pressure or a negative pressure can be generated in the interior of the metering roller 16.3, with the result that powder can be sucked into the metering chamber 54.3 from the outside or forced out of the same in the outward direction. This is known, in principle, in the prior art.

Figure 6:
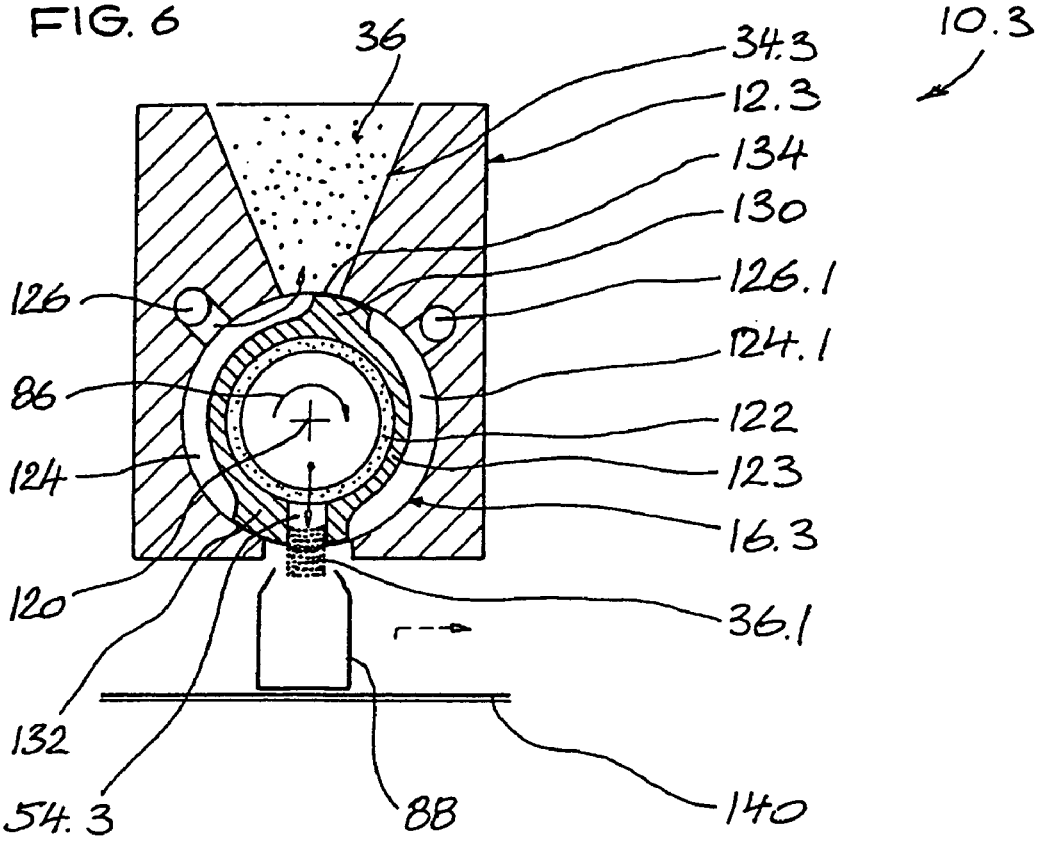

Located approximately opposite one another on the outside of the metering roller 16.3 are two trough-like or groove-like recessed formations which constitute a first and a second lateral line 124, 124.1, as is basically the case with the lateral line 24 of the dispensing apparatus 10. Opening out into the left-hand lateral line 124 in FIG. 6 is a first gas line 126, through which, just as through the abovedescribed gas line 44, a gaseous medium can be introduced into the region of the first lateral line 124. In a comparable manner, the second lateral line 124.1 is line-connected to a second gas line 126.1, which terminates in the housing 12.3, in which the metering roller 16.3 is mounted in a rotatable manner. It is thus also possible for gas to be introduced into the second lateral line 124.1 through the second gas line 126.1.

The two gas lines 126, 126.1 are not connected to one another. At one end, the two lateral lines 124, 124.1 are separated from one another by a tube region 130 of the metering chamber 54.3. The metering chamber 54.3 is located at the other end of the two lateral lines 124, 124.1. The tube region 132, which encloses the metering chamber 54.3, does not just form the sleeve-like body for the metering chamber 54.3; it also separates the two lateral lines 124, 124.1 from one another in this region of the metering chamber 54.3.

FIG. 6 illustrates the state in which, by virtue of a positive pressure being built up in the interior of the metering roller 16.3, the quantity of powder 36.1 which is present in the metering chamber 54.3 is forced downward into an available container 88. During this operation of emptying the metering chamber 54.3, gas is introduced through the first gas line 126, and via the first lateral line 124, into the material store 34.3, which is present above the metering roller 16.3. Like the material store 34, the material store 34.3 is of hopper-like, downwardly tapering design. In the present case, it comprises a corresponding aperture in the housing 12.3. The bottom opening periphery 134 of the material store 34.3 has a concave shape, which corresponds to the convex outer shape of the metering roller 16.3.

In the case of the rotary position which is illustrated in FIG. 6, the pulverulent contents 36 which are present in the material store 34.3 can be fluidized merely through the first lateral line 124. In this rotary position, the second gas line 126.1 has no line connection into the material store 34.3. In the present example, it is also the case that the second gas line 126.1 has no line connection out of the region of the metering roller 16.3 in the downward direction or out of the housing 12.3.

It is thus possible, in the same way as with the dispensing apparatus illustrated in FIG. 3, for the pulverulent contents which are present in the material store to be fluidized simultaneously during the operation of emptying the respective metering chamber.

Whereas, in the case of the apparatuses 10 and 10.2, the metering roller 16, 16.2 is rotated back and forth in an oscillating manner, the metering roller 16.3 of the apparatus 10.3 illustrated in FIG. 6*ff* can be rotated in the same direction (clockwise direction 86).

Following its emptying position, which is illustrated in FIG. 6, the metering roller 16.3 rotates into its rotary position which is illustrated in FIG. 7. In this position, the contents 36 are fluidized via the first gas line 126 and first lateral line 124. As before, it is not possible for fluidization to take place via the second gas line 126.1.

Through this second gas line 126.1, it would be possible to introduce into the region of the second lateral line 124.1 gas which would pass out of this lateral line at the bottom from the region of the metering chamber 54.3. If this were undesirable, it would also be possible to interrupt the gas throughflow into the second gas line 126.1 and thus into the region of the second lateral line 124.1.

With continued rotation of the metering roller 16.3, the latter passes into its rotary position which is illustrated in FIG. 8. In this position, gas can flow through the two gas lines 126, 126.1, via the two lateral lines 124, 124.1, into the material store 34.3, and the pulverulent contents 36 which are stored in the latter can thus be fluidized.

With continued rotation of the metering roller 16.3 into the position which is illustrated in FIG. 9, the tube region 132 of the metering roller 16.3 closes the first gas line 126, with the result that it is not possible for any gas to be introduced into the first lateral line 124 via this first gas line. This first lateral line 124, however, is then line-connected to the second gas line 126.1, with the result that the contents 36, as before, can be fluidized via this second gas line.

With continued rotation of the metering roller 16.3 into its rotary position which is illustrated in FIG. 10, the metering chamber 54.3 passes into the region of direct influence of the first gas line 126. It would then be possible, by virtue of a positive pressure being built up in the interior of the metering roller 16.3 and/or by virtue of a negative pressure being applied in the first gas line 126, for the remaining pulverulent contents, which were not removed in their entirety from the metering chamber 54.3 during the emptying operation, to be blown out of the metering chamber 54.3 and into the gas line 126. It would then be possible for such pulverulent contents which have passed into the first gas line 126, if the contents 36 are fluidized in the material store 34.3 again through the first gas line 126, to be blown back into this material store 34.3 and thus for the gas line 126 to be cleaned again.

The pulverulent contents 36 which are present in the material store 34.3, as before, can be fluidized via the second gas line 126.1 and the now first lateral line 124.

In that rotary position of the metering roller 16.3 which is illustrated in FIG. 11, the metering chamber 54.3 of the metering roller has passed into the base region of the material store 34.3, which is enclosed by the opening periphery 134 of said store 34.3. It is then possible, by virtue of a negative pressure being applied in the interior of the metering roller 16.3, for pulverulent, fluidized contents 36 to be sucked out of the material store 34.3 into the available metering chamber 54.3. During this operation of filling the metering chamber 54.3, the two lateral lines 124, 124.1 are not line-connected to the material store 34.3.

With continued rotation of the metering roller 16.3 into its rotary position which is illustrated in FIG. 12, one lateral line 124.1 is line-connected again to the material store 34.3. It is then possible for gas to be introduced into the material store 34.3 again through the first gas line 126, and via the second lateral line 124.1, and for the contents 36 which are present in the material store to be fluidized. In this position, the contents-filled metering chamber 54.3 is located in the region of direct influence of the second gas line 126.1. It is not permitted to apply either a negative pressure or a positive pressure to this second gas line 126.1, in order that the contents introduced in the metering chamber 54.3 are not influenced. In this case, a negative pressure is applied in the interior of the metering roller 16.3, in order to keep the contents in the metering chamber 54.3 during the rotary movement of the metering roller.

In the following rotary position, which is illustrated in FIG. 13, the contents 36 which are present in the interior of the material store 34.3 can be fluidized again via the second gas line 126.1 and the second lateral line 124.1. Fluidization via the first gas line 126 is not possible. This is prevented by the tube region 130, which line-disconnects the material store 34.3 from the first lateral line 124 in the region of the metering roller 16.3. A negative pressure still prevails in the interior of the metering roller 16.3.

With continued rotation of the metering roller 16.3 into its position which is illustrated in FIG. 14, and in which a negative pressure also likewise prevails in the interior of the metering roller 16.3, only weakened fluidization of the contents 36 is still possible. This is because the tube region 130 has already largely closed the bottom opening of the material store 34.3.

The metering roller 16.3 is then rotated further again into its position which is illustrated in FIG. 6, and the contents 36 which are present in its metering chamber 54.3, by virtue of a positive pressure being applied in the interior of the metering roller 16.3, are introduced into a further container 88.1 which has been moved up into position. The containers 88, 88.1, etc. are guided past the bottom opening of the housing 12.3 in a state in which they stand on a transporting belt 140.

The opening periphery 134 of the material store 34.3 (FIG. 11) acts as a doctor-blade edge in order for the contents which are introduced in a metering chamber 54.3 and the remaining contents which are present in the material store 34.3 to be separated precisely during the rotary movement of the metering roller 16.3 and thus during the movement of the metering roller 16.3 past the opening periphery 134 of the material store 34.3 (FIG. 11).

It is clear from the above that the contents 36 which are present in the material store can be subjected to the action of gas from one or two gas lines 126, 126.1. In order to achieve uniform fluidization, it may be recommendable to provide a gas-volume-flow regulating device, by means of which the gas is introduced into the two gas lines 126, 126.1 such that always the same quantity of gas flows into the material store 34.3. A uniform quantity of gas results in a uniform fluidized bed of contents 36 in the material store 34.3, which, in turn, ensures identical pressure and flow conditions for the contents which are present in the material store 34.3. In this context, it is further recommended to combine the two gas lines 126, 126.1 in a common line, for example, outside the housing 12.3, in which case only a single volume-flow regulating means would have to be provided.

In the case of the abovedescribed fluidizing operation, it is possible to fluidize all the contents which are present in the material store 34.3. The fluidization takes place in parallel with other operating sequences. It is thus possible to ensure a high dispensing performance along with low fluctuation of the quantity dispensed.

Instead of one metering chamber, it is also possible to provide a plurality of metering chambers with, correspondingly, a plurality of lateral lines and gas lines.

In the present examples, the filter piston apparatuses each have circular cross-sectional shapes. Filter piston apparatuses could also have non-circular cross-sectional shapes. In this case, the circular bore 52 would have to be replaced by a channel with a cross-sectional shape which is adapted to the respective piston.

The invention claimed is:

1. A method of dispensing respectively predetermined quantities of pulverulent contents into containers comprising the steps of, introducing a gas through a gas line to fluidize contents stored in a material store, sucking out the contents of the material store into at least one metering chamber of a metering roller located in a corresponding rotary position, rotating the metering roller into another rotary position such that its metering chamber moves in front of the opening of a container which is to be filled, forcing the contents out of the metering chamber by means of gas, with the result that they pass into the container and, wherein introducing, where the at least one metering chamber of the latter is not line-connected to the material store, a gaseous medium through the gas line, into at least one lateral line located in the metering roller, and passing this gaseous medium on into the material store out of this lateral line, with the result that in dependence on the rotary positions of the metering roller, the gas line which serves for fluidizing the contents present in the material store is closed or opened by the metering roller.

2. The method as claimed in claim 1,
wherein introducing the gaseous medium into the storage material store via the lateral line with the metering chamber located in front of the opening of the container which is to be filled.

3. The method as claimed in claim 1 or 2,
further including the step of:

rotating the metering roller in the same direction of rotation, or in an oscillating rotary movement, upon successive filling and emptying of the metering chamber.

4. The method as claimed in claim 1 or 2,
further including the step of:

filling the gas line constantly with gaseous medium which is subjected to pressure in the gas line.

5. An apparatus for dispensing respectively predetermined quantities of pulverulent contents comprising, a rotatably drivable metering roller containing at least one metering chamber, a material store which stores pulverulent contents, a housing which has a concave surface region which is adapted to the convex surface shape of the metering roller such that, during its rotary movement, the metering roller butts tightly against the concave surface region of the housing, a device for introducing gas into the material store, a device for generating a positive gas pressure or a negative gas pressure in the metering chamber,
wherein the metering roller contains at least one lateral line with two line ends, which is not line-connected to the metering chamber and of which at least the two line ends terminate on the surface of the metering roller and, a gas line guided into the housing and passing out of the housing again in the concave surface region, it being possible for gas to be introduced into the material store via the gas and the lateral line, in dependence on the respective rotary position of the metering roller, wherein in a first rotary position of the metering roller, the at least one metering chamber of the latter is line-connected to the material store and, in this position, each of the lateral lines present are simultaneously not line-connected either to the gas line or to the material store, with the result that the gas line is not line-connected to the material store.

6. The apparatus as claimed in claim 5,
wherein in a second rotary position of the metering roller, the at least one metering chamber is located in front of the opening of the container which is to be filled and, in this position the metering roller, prevents any gas flow out of the gas line via lateral lines from this opening, and in the second rotary position of the metering roller, gas is introduced into the material store via the lateral line.

7. The apparatus as claimed in claim 5 or 6,
wherein the pulverulent contents are in the form of powdered medication or powdered foodstuffs or powdered semi-luxury goods.

8. The apparatus as claimed in claim 5 or 6,
wherein each gas line is attached to a compressed-air source or to a compressed inert-gas source.

9. The apparatus as claimed in claim 5 or 6,
wherein the housing contains at least one first through-passage channel, which has one end terminating in a first region of the concave surface region and its other end attached to the material store, the housing contains at least one second trough-passage channel, which has one end terminating in a second region of the concave surface region and its other end attached to a compressed-air source or compressed inert-gas source.

10. The apparatus as claimed in claim 9, wherein the first and second through-passage channels are each produced as through-passage bores.

11. The apparatus as claimed in claim 9, wherein the other end of the first through-passage channel opens out into an accommodating bore with a larger cross section, the cross section of the accommodating bore and the cross section of the first though-passage channel are adapted to the inner and outer cross section of a connecting hose which is plugged into the accommodating bore, such that the connecting hose is retained in a force-fitting manner in the accommodating bore, and a small, virtually negligible flow resistance is present in the transition region between the connecting hose and first through-passage channel.

12. The apparatus as claimed in claim 10, wherein a gas hose which has one end respectively attached to the compressed-air source or compressed inert-gas source and the other end of the second through-passage channel.

13. The apparatus as claimed in claim 12, wherein the other end of the second through-passage channel opens out into an accommodating bore with a larger cross section.

14. The apparatus as claimed in claim 11, wherein the connecting hose is a silicone hose.

15. The apparatus as claimed in claim 5 or 6, wherein the metering roller contains a hollow-cylindrical piston, arranged in a circular-cylindrical bore, as part of a filter piston apparatus, the filter piston apparatus has a piston plate which closes the interior of the hollow-cylindrical piston and is designed as a filter which is permeable to gaseous medium and impermeable to the contents, the filter piston apparatus has a metering chamber in part, in the end region of the circular-cylindrical bore and has its base formed by the filter of the piston, the metering chamber is attached to a positive-pressure or negative-pressure gas source through the filter, the wall of the piston has a transverse slot and an inner groove located radially opposite the transverse slot, such that the filter is adapted to be pushed into the transverse slot from the outside and, is seated in the piston, said filter also being adapted to be secured on both sides in the axial direction of the piston along its encircling periphery.

16. The apparatus as claimed in claim 1, 2, 5 or 6, wherein the material store has a hopper which tapers in the direction of its outlet opening, the inclination of the hopper wall in adaptation to the respective contents is of such a magnitude that the contents running out of all the regions of the hopper move to the same extent toward the outlet opening.

17. The apparatus as claimed in claim 16, wherein the material store can be closed by a cover which is impermeable to contents but permeable to gas.

18. The apparatus as claimed in claim 16, wherein the hopper has a piece of tube which forms its outlet opening and into which the connecting hose leading to the first through-passage channel can be plugged in a force-fitting manner such that the internal diameter of the piece of tube corresponds to the internal diameter both of the connecting hose and of the first through-passage channel.

19. The apparatus as claimed in claim 11, wherein a gas hose which has one end attached to the compressed-air source or compressed inert-gas source and the other end of the second through-passage channel.

20. The apparatus as claimed in claim 19, wherein the other end of the second through-passage channel opens out into an accommodating bore with a larger cross section.

21. The apparatus as claimed in claim 17, wherein the hopper has a piece of tube which forms its outlet opening and into which the connecting hose leading to the first through-passage channel can be plugged in a force-fitting manner such that the internal diameter of the piece of tube corresponds to the internal diameter both of the connecting hose and of the first through-passage channel.

* * * * *